United States Patent [19]

Smith

[11] Patent Number: 4,565,183

[45] Date of Patent: Jan. 21, 1986

[54] SPRING TYPE BALL PROJECTING DEVICE

[76] Inventor: Samuel C. Smith, 210 Hartman Road, Newton Centre, Mass. 02159

[21] Appl. No.: 428,250

[22] Filed: Sep. 29, 1982

[51] Int. Cl.[4] ..... F41B 7/00

[52] U.S. Cl. ..... 124/26

[58] Field of Search ..... 124/16, 17, 27, 37, 124/40, 41 R, 51 R, 82, 50; 273/418

[56] References Cited

U.S. PATENT DOCUMENTS 262,644 8/1882 Connelly ..... 124/27

2,437,727 3/1948 Drumheller ..... 124/27

2,458,828 1/1949 Boese ..... 124/27

4,133,452 1/1979 Wiltrout ..... 124/27 X

*Primary Examiner*—Richard J. Apley

*Assistant Examiner*—William R. Browne

[57] ABSTRACT

A spring-actuated plunger in an elongated tube imparts a directional force to a spongy projectile. A gravity release pin for cocking the plunger permits rapid firing. A loading magazine with a releasable spring-loaded ball permits either gravity or manual loading. Dye-impregnated projectiles stun rather than injure would-be attackers and leave an imprint not visible to the naked eye.

8 Claims, 3 Drawing Figures

SPRING TYPE BALL PROJECTING DEVICE

The present invention relates to projecting devices but more particularly to self-defense devices for protection against attackers.

In the home, on the street-on foot or in a vehicle-one is subject to be confronted, when least expected, by attackers whose intention, generally, is to rob or molest one. For obvious reasons, the victim is usually not in a position to protect himself in such circumstances; nor can the victim behave and react in a normal manner. The undesirable consequences of lethal weapons are well known. Other non-lethal devices appear to lack adequate effectiveness.

Accordingly, it is an object of the present invention to protect individuals against attackers.

A more general object is to have the required protection without causing fatality.

An even more general object is to have a protective device that can be used at a safe distance and with ease. Said device requiring very little thought, concentration and procedural steps at time of need.

Another object is to facilitate the apprehension of the attacker.

The foregoing objects are achieved in accordance with the present invention by a relatively small and compact unit comprising of a tube or cylinder, a rod having a shoulder and a compression spring. In addition, a magazine means is provided to store projectiles and to effect easy reloading. In accordance with a related feature of the invention, a pair of resilient leaf-like component is designed to trap a ball or projectile thereby limiting its movement prior to firing. Still another feature is a means of retaining balls in the magazine, free from contact with the actuating spring and the ball already in the cylinder. This ball retaining feature is particularly effective when it is desired to use the optional method of placing the actuator rod in its retracting position in readiness for eventual use. In this case, the cylinder is kept empty until retraction is completed.

The foregoing objects and features of the present invention will be better understood from the following detailed description of an illustrative embodiment taken in connection with the accompanying drawings in which.

Figure 3:
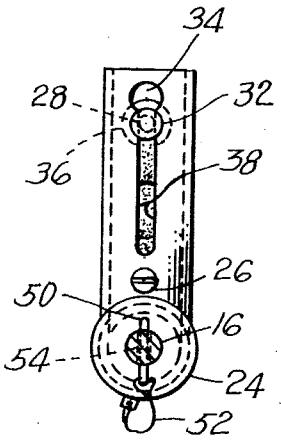
FIG. 3 is an end view without the handle showing the feeder elements of the magazine according to the present invention.
Figure 1:
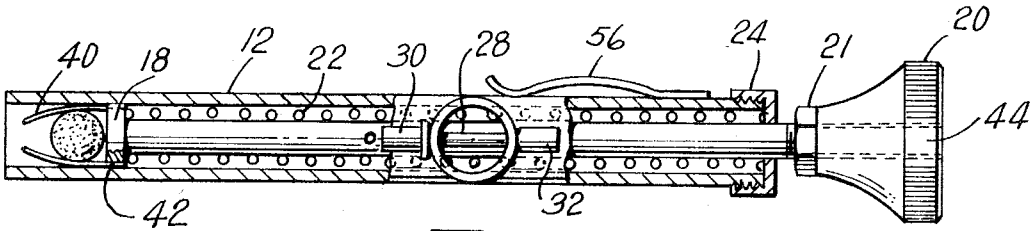
FIG. 1 is a view in plan elevation of a self-defense projectile device according to the present invention.
Figure 2:
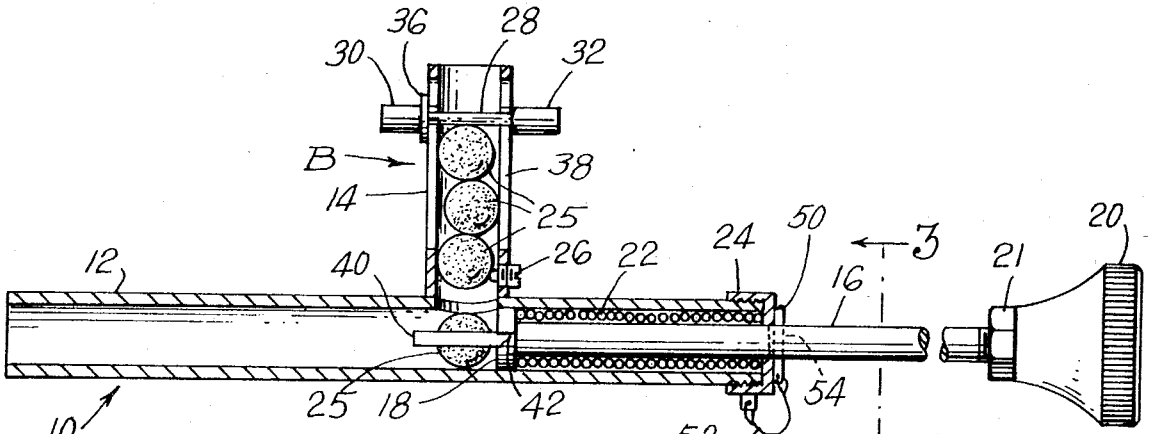
FIG. 2 is a view of an assembly showing the device in retracted position as seen from the side according to the present invention.

Turning now to the drawings, there is shown a body 10 comprising of a cylinder 12 and magazine 14, the two being perpendicularly joined as by brazing or bonding. The magazine stores some number of balls B and releases them one at a time. A rod 16 with an integral head or shoulder 18 and handle 20 moves, with a slide fit, laterally in the cylinder as it compresses and retracts spring 22 which is constrained between the rod head 18 and cylinder nut 24. While it is practical to feed the ball 25 by gravity, a superior method is to use mechanical means. This is accomplished by providing adjustable ball plunger 26 and feeder 28. Feeder 28 is composed of a pin having two heads 30 and 32. Head 30 is slightly smaller in diameter than head 32 which allows it to go through a slightly larger hole 34 in the magazine. When in inserted position, a retaining ring 36 retains the feeder 28 in place and feeder can then slide, as required, in slot 38. Slot 38 is a continuation of and in direct alignment with one-diameter through hole 34.

It is to be noted that the accessibility of the feeder does not eliminate the use of gravity feeding. If by choice, because of anticipated state of the mind or otherwise, further reduction of steps is necessary, gravity feeding can be introduced by simply backing off the ball plunger 26.

When in the cylinder, it is preferred that the ball be limited in to-and-fro movement. For this reason, a pair of resilient leaf-like or spring wire fingers 40 is fastened as by bonding in opposite slots 42. In a normal position of the assembly, the resilient fingers are seen to be on the sides-as against top and bottom. In this position, a flat 44 is milled on the top of handle 20 to indicate that the fingers are in position to trap the ball. The size, flexibility and other mechanical characteristics of the fingers are such that no concern need be given to exact position of the flat when using the device. The ball will drop in place even if far-out-of-alignment exists.

A special feature of the invention is to incorporate a ready-to-project function without introducing new action and thought or concentration factors at time of need. A pin 50 having one end fastened to a chain 52 of suitable length and the other end of the chain fastened to nut 24, is available for insertion in an enlarged hole 54 when the rod 16 is pulled or retracted almost to its limit. After inserting pin and letting go of rod, the device is locked in an engaged position by virtue of the pin 50 being forced against surface of hole 54 and face of nut 24. With this position, desirable before retiring for the night or when in a car apprehensively, even less effort is required-a slight pull-then would be the case with the absence of pin 50.

A clip 56 provides means of fastening the device to pocket of clothing.

The balls B are to be impregnated with a suitable chemical compound so as to render a bibulous missile which, upon striking the attacker, leaves a mark visible only by using appropriate instruments or equipment such as an ultra violet ray lamp. This will facilitate ultimate apprehension of the criminal.

As indicated, the purpose of the self-defense device is not to maim but to temporarily disable and frighten the offender as well as to assist in capturing him. The necessary effective force is generally controlled by a spring having such physical characteristics as to enable a less-than-strong person to comfortably retract the rod and plunger. As a practical guide, the force criterion in combination with a missile weighing less than $\frac{1}{4}$ ounce will generally impart effective pain at a distance of about 10 feet.

In preparing for use, cartridge 14 is loaded to full capacity with balls B. With feeder 28 in place but without retainer ring 36, apply reasonable pressure on the feeder while adjusting ball plunger 26. When proper adjustment is attained, remove feeder, all balls or missiles including the one dropped in the cylinder. Now put balls back in the magazine, put feeder in place and insert the retainer ring 36. Next, assemble the rod or plunger unit by first pulling the rod through the spring then in the cylinder and finally screwing on nut 24 and handle 20. The next step is to retract the rod 16 by means of the handle 20 about a pin and a half diameter short of its limit. With a marker, draw an arc to include the spot where hole 54 is to be drilled. Next, disassemble rod unit, prick punch a point along the marked rod perpendicularly to the fingers 40 and drill a hole with liberal clearance for the pin 50.

Reassemble rod unit taking care that the flat portion 44 of handle 20 is on top and locked when the pin 50 is in a vertical position.

In operation, handle 20 is pulled to its limit and pin 50 is inserted from the underside of the rod 16. The rod is then let go and the pin 50 is forced against the surface of hole 54 and face of nut 24 thereby securing the retracted device. Next, the feeder 28 is pressed down releasing a ball to the fingers 40 in the cylinder 12 where it is ready to expel at the proper time.

To fire, simply pull rod 16 via the handle 20 and release. As rod 16 is pulled, pin 50 is relieved from its jammed position and drops out of the hole 54 by gravity. Additional shootings require pulling the rod 16, pressing down the feeder 28 and releasing the rod 16. Should it be the choice to eliminate the use of the feeder as aforementioned, repeated shootings require only retracting and releasing the rod 16.

From the above description of an illustrative embodiment, taken in connection with the accompanying drawings, many variations within the scope of the invention will become apparent to those of ordinary skill in the art. It is therefore not intended that the specification and drawings be taken in a limiting sense but rather that the scope of the invention be interpreted in terms of the appended claims.

Having thus disclosed my invention, what I claim as new and desire to secure by Letters Patent of the United States is:

1. A quick-release transportable pocket-sized, rapid fire nonlethal projectile launcher comprising a firing cylinder for receiving and launching projectiles and a spring-actuated plunger moving slidably within the cylinder, an enlarged diameter or shoulder at an end of the plunger to counter the force of a compression spring, spring leaf finger means at opposing sides of the shoulder of the plunger embracingly positioned for restricting movement of a projectile nested in the cylinder, orthogonal to and interconnected with the cylinder, a magazine means for storing spare projectiles until ready to be transferred to the firing cylinder between the firing cylinder and the magazine, a spring loaded adjustable ball retainer means at the base of the magazine, to control the release of stored projectiles, for reversible manual or gravity feed, moving slidably within a slot in the magazine, a protruding rod feeder means to release projectiles by forcing the stored projectiles past the plunger one-at-a-time, a gravity-release pin cocking means, attached by a chain to the cylinder, to retain the plunger in a withdrawn position and place the projectile launcher in readiness for launching a projectile, which pin falls out upon pulling back the plunger, and a clip means for fastening the projectile launcher in a pocket of clothing of the user.

2. The device of claim 1 in which the spring-actuated plunger comprises a spring having appropriate physical characteristics as to effect results without causing fatality, wherein the appropriateness resides generally in a compression spring having such general characteristics as high resiliency wire, 0.044" wire diameter, 3/8" O.D., $3\frac{3}{4}$" free length and 5/32" pitch.

3. The device of claim 1 wherein the spring-loaded adjustable ball retainer means comprises a spring-loaded ball setscrew adjustable to sustain the stored projectiles for manual feeding, and a pair of aligned slots joined and in alignment with a pair of through holes located at the top of the slots, are provided to permit movement of the protruding rod thereon for pressing on the rod to force one projectile at a time past the spring-loaded adjustable ball into the firing cylinder.

4. The device of claim 3 wherein the projectile feeder means comprises a rod having two larger diameters at the extreme ends, one of which being larger than the other in order to be insertable in the through holes above the slots without the larger diameter end going through, and a retainer ring means is cooperatively used with the smaller diameter end to secure the rod slidably within the holes.

5. The device of claim 3 wherein the spring-loaded ball retainer means which is a setscrew is retracted to prevent contact with the projectiles in the magazine and projectile feeding is effected by gravity.

6. The device of claim 1 wherein a projectile end of the plunger is provided with a slot at each of two opposing sides and the means to limit missile movement comprises a pair of curved resilient fingers cooperatively fastened to the slots in the rod shoulder at the end of the plunger.

7. The device of claim 1 wherein the projectile is provided with a spongy surface and a means for imprinting an invisible mark on an attacker said mark comprises impregnating the spongy surface of the projectile with a dye visible only with the aid of optical or light device.

8. The device of claim 1 wherein the plunger is provided with a transverse hole and the cocking means comprises a secured pin inserted in the hole in the plunger when said plunger is retracted and remains in said retracted position until retraction again takes place in which case said pin drops out of the hole by gravity.

* * * * *